US005447256A

United States Patent [19]

Graham

[11] Patent Number: 5,447,256

[45] Date of Patent: Sep. 5, 1995

[54] BOTTLE ENCLOSURE WITH DRIP TRAY

[76] Inventor: Michael J. Graham, 2635 23rd #A, Santa Monica, Calif. 90405

[21] Appl. No.: 291,291

[22] Filed: Aug. 16, 1994

[51] Int. Cl.[6] ..... B67D 1/16

[52] U.S. Cl. ..... 222/108; 141/1; 141/87; 141/88; 141/357; 141/362; 222/183

[58] Field of Search ..... 222/108, 183; 141/1, 141/86–88, 357, 362; 137/312, 313

[56] References Cited

U.S. PATENT DOCUMENTS

| | | | |
|---|---|---|---|
| 178,489 | 6/1876 | Unkrich | 141/87 |
| 1,660,074 | 2/1928 | Hagg | 222/108 |
| 2,080,923 | 5/1937 | Lassen | 222/108 X |
| 2,520,380 | 8/1950 | Wegman | 222/108 |
| 2,785,836 | 3/1957 | Smith et al. | 222/108 X |
| 2,834,516 | 5/1958 | Mosher | 222/108 |
| 3,026,005 | 3/1962 | Cook | 222/183 X |
| 3,232,491 | 2/1966 | Hunt | 222/183 X |
| 3,327,902 | 6/1967 | Alterwitz | 222/108 |
| 3,627,399 | 12/1971 | Addison | 222/183 X |
| 3,696,969 | 10/1972 | De Van et al. | 222/183 X |
| 3,794,219 | 2/1974 | Pitel et al. | 141/88 X |
| 3,830,406 | 8/1974 | Robb | 222/183 X |
| 3,964,636 | 6/1976 | Rehrig | 222/183 X |
| 5,285,989 | 2/1994 | Zilbert et al. | 141/87 X |

*Primary Examiner*—Kevin P. Shaver

*Attorney, Agent, or Firm*—Macro-Search Corp.; Gene Scott

[57] ABSTRACT

The present invention relates to an enclosure housing a fluid container having a retractable drip tray slidably mounted therein whereas when a cup or glass is pushed against the front of the drip tray, the drip tray retracts into the housing, compressing the V-spring, allowing filling from the fluid container spout. When the cup or glass is removed, the V-spring is relaxed, extending the drip tray outwardly to catch any drips from the fluid container spout.

9 Claims, 4 Drawing Sheets

BOTTLE ENCLOSURE WITH DRIP TRAY

BACKGROUND OF THE INVENTION

1. Field of the Invention

This invention relates generally to improvements in bottled water dispenser stations of this type adapted to receive and support a water bottle in an inverted position, and to selectively dispense water therefrom. More specifically, this invention relates to an improved bottled water station having a retractable reservoir drip tray.

2. Description of the Prior Art

Conventional prior art supports for liquid jugs are well known. For example, supports can be used for transporting fluids such as gasoline in a jug when additional gasoline is required in addition to that contained in the fuel tank. Other racks may be used to support other types of fluid jugs. The present invention utilizes a mounting rack which enables the water jug to be transported in a truck bed and repositioned on the truck bed for use when the truck is no longer in transit, enabling easy access to the water jug without entering the truck bed. In addition, the present invention enables the water jug and the support structure to be removed from the truck and repositioned to a place where the water jug can be used. Known prior art includes U.S. Pat. Nos. 1,639,563; 1,740,368; 1,600,181; 1,617,768; 3,815,386; 4,327,849; and 4,006,852.

The increased pollution of water systems throughout the country has created a tremendous demand for clean potable water of a known source. Health fears have risen as a result of the contamination of various domestic water supply systems with chemicals which either cause the closure of the system or increase the health risks to its users. Stand alone water cooler have been known in the office environment for many years. Originally, purchased and utilized as a convenience, it has now become increasingly popular due to health fears concerning the piped in municipal water supply. In the home, there has been an increased demand for bottled water from a known source. The water has been typically sold as spring, mountain, purified, or distilled water. While the demand for bottle water has increased in the home, it has not replaced the convenience of tap water available from the municipal supplier.

Suppliers of spring water have attempted to supply the domestic user with water bottles and coolers like those found in the office environment. U.S. Pat. Nos. 4,646,944, 4,516,693, 4,373,647, 4,293,082, 3,966,093 and 3,843,021 are all variations on the office environment cooler, a stand alone unit which takes up unavailable floor space in the typical kitchen.

In supermarkets, two and one-half gallon plastic containers of spring water or purified water, with attached spigots, are now widely available. However, the consumer has had to store these bottles of water in their refrigerator, requiting the continual opening and closing of the refrigerator to obtain water. This inconvenience has resulted in many people doing without the bottled water. Additionally, the bottles themselves have been designed to hold large quantities of water and therefore occupy a large amount of space in the refrigerator.

The disadvantages of bottled water has resulted in less use than would occur if delivery of the water would be similar to that of the domestic tap. The invention herein obviates the above disadvantages of storing bottled water in a convenient holder and location, as well as making its use more practicable.

Bottled water dispenser stations are well known in the art for containing a supply of relatively purified water in a convenient manner and location ready for substantially immediate dispensing and use. Such bottled water stations commonly include an upwardly open reservoir mounted on a station housing and adapted to receive and support an inverted water bottle of typically three to five gallon capacity. Water within the inverted boule flows downwardly into the station reservoir for selective dispensing therefrom through a faucet valve on the front of the station housing. Such bottled water stations are widely used to provide a clean and safe source of water for drinking and cooking especially in areas wherein the local water supply is suspected contained undesired levels of contaminants.

In bottled water stations of the above described type, the water bottles are normally provided in a clean and preferably sterile condition with an appropriate sealed cap to prevent contamination of the water contained therein. When an inverted bottle on a station housing reaches an empty condition, the empty bottle can be lifted quickly and easily from the station housing and replaced by a filled bottle having the sealing cap removed therefrom. The empty bottle can then be returned to the bottled water vendor for cleaning and refilling.

Although bottled water stations of this type utilize a sequence of water bottles which have been individually sanitized, the water reservoir within the station housing is not subjected to periodic cleaning or replacement. In this regard, the housing reservoir commonly comprises a metal or ceramic tank mounted within the station housing in association with a refrigeration system for maintaining water within the reservoir in chilled condition. In other station housing designs, an auxiliary reservoir is provided in association with suitable heating elements for providing a heated water supply. Unfortunately, the integration of the station housing reservoir with associated chilling and/or heating systems has generally precluded easy reservoir removal for cleaning purposes. Instead, the housing reservoir has typically been used for prolonged time periods without cleaning, thus creating the potential for undesirable growth of harmful bacteria and other organisms. Reservoir cleaning has generally been possible by taking the station out of service and returning the station to a centralized facility for cleaning purposes.

In one proposed construction for a bottled water suggested for easy drop-in placement and lift-out removal with respect to a supporting chiller plate within a station housing. See U.S. Pat. No. 4,629,096. While this configuration beneficially permits reservoir removal for cleaning purposes, no provision has been made to supply a desirable heated water supply in addition to a chilled water supply. Moreover, the supported placement of the removable container onto a refrigerated chiller plate inherently and undesirably provides a large surface area and associated space conductive to frost and/or condensation build-up between the chiller plate and the reservoir container.

The present invention overcomes the problems and disadvantages of the prior art by providing an improved bottled water station having a water container enclosure with retractable drip tray adapted for simple installation into a kitchen, and for correspondingly simple slide-out removal of water bottles therefrom. Accordingly, the water bottle may be removed from the water container enclosure with retractable drip tray quickly and easily for cleaning purposes, with a clean replacement water bottle being easily installed into the water container enclosure with retractable drip tray to permit the bottled water station to remain in service. The improved bottled water container enclosure with retractable drip tray may be further adapted to minimize or eliminate frost and condensation associated with refrigerated chiller equipment, and is compatible for supply of both chilled and heated water supplies when installed within a cooled environment.

A cooler and dispenser for bottled water normally may have a cooling reservoir within which the inverted neck of a water bottle is disposed. Typically a refrigeration system cools the reservoir and the water being held there. Additionally, some systems are provided with an additional tank, supplied with water from the reservoir, and have a heating system which provides hot water. Water is dispensed by draining the reservoir, usually through a faucet.

Some systems are provided with a cap over the neck of the water bottle so that upon inverting, water is contained until the water bottle is properly inserted into the water cooler. In the order to provide fluids communication, these types of water coolers are often provided with a feed tube which pierces the cap upon insertion of the inverted bottle in the cooler and provides a conduit to dispense water into the reservoir. Water coolers of this general type can be found in U.S. Pat. No. 4,699,188 to Baker et al.

It sometimes becomes necessary to replace a partially empty water bottle with a new water bottle containing either the same liquid or a different liquid, or otherwise remove a partially filled water bottle. In conventional systems, however, upon removal, water is discharged through the neck of the water bottle without control. One solution to a similar problem is presented as a resealable plug-type fitting for use with flexible bag containers and is described in U.S. Pat. No. Re. 32,354 to Chester Savage, assignor to Scholle Corporation. An improved hygienic liquid dispensing system for use in water bottle coolers which allows for the removal of a partially filled water bottle is necessary.

Many types of water dispensing housings have heretofore been proposed for use particularly in supporting various items such as containers. A representative sample of the prior art is disclosed in the following U.S. Patents:

U.S. Pat. No. 2,302,170 issued to Basler
U.S. Pat. No. 3,627,248 issued to Nelson
U.S. Pat. No. 3,278,148 issued to Denaro
U.S. Pat. No. 3,652,049 issued to McCown
U.S. Pat. No. 3,666,223 issued to Moore None of the prior art brackets have been designed specifically for holding one of the new containers which are typically produced from plastic and which have hollow thin-walled handles and linear reliefs positioned on the bottom of water bottles which are integrally formed into the main body of the container. Disclosed herein is such a bracket which has been designed specifically for this type of container.

Numerous innovations for a fluid container housing with retractable drip tray have been provided in the prior art that are described as follows. Even though these innovations may be suitable for the specific individual purposes to which they address, they differ from the present invention as hereinafter contrasted.

U.S. Pat. No. 4,860,986

MOUNTING RACK

Kenneth A. Conzens

A mounting rack for a water jug includes a vertical arm interconnected at one end to a support and its other end to a mounting structure. The support and its other end to a mounting structure. The support has means for supporting the bottom base of the water jug. A jug securing mechanism is integrally formed with a vertical arm for securing the jug at the jug sides to the mounting rack. The mounting structure has means for connecting the mounting rack to a fixed structure.

The present invention differs significantly from the above described patent due to the following unique features described in the present invention such as: open front side, closed rear side, right and left sides having vertical openings contained therein, retractable drip tray with spring-like return means, and support brackets containing holes therein for mounting said apparatus against and/or under a kitchen cabinet.

U.S. Pat. No. 3,614,982

COOLING SYSTEM

John M. Krizman

An improvement to a cooling system which includes a radiator for the circulation of a liquid coolant there through and a coolant receptacle connected to the overflow outlet of the radiator. The improvement concerns a flexible shape-retaining wire holder which is attached to a support adjacent the radiator and which includes two generally parallel oppositely spaced U-shaped wire brackets. The coolant receptacle is seated within the wire holder and includes protruding side and bottom wall portions which are straddled by the U-shaped brackets of the holder.

The present invention differs significantly from the above described patent due to the following unique features described in the present invention such as: open front side, closed rear side, right and left sides having vertical openings contained therein, retractable drip tray with spring-like return means, and support brackets containing holes therein for mounting said apparatus against and/or under a kitchen cabinet.

U.S. Pat. No. 4,866,945

COUNTERTOP WATER COOLER

Richard S. Bender, Lawrence Pleet

A countertop cooler for standard size water bottles where the plastic bottle has a spigot at the lower front end of said bottle which allows withdrawal of water, said water bottle enclosed in a refrigeration case for cooling; said refrigeration case having a removable top in which said bottle and removable top section of said cooler is held in place be a means for securing said removable section in place to close the refrigeration case. Within the refrigeration case is a metal conductive cooling surface member extending from the rear of said case extending along at least a substantial portion of the bottom and sides of said refrigeration case, cooling said water bottle by conduction, with a cooling means preferably thermoelectric incorporated within said cooler;

and in engagement with the metal cooling surface member.

The present invention differs significantly from the above described patent due to the following unique features described in the present invention such as: open front side, closed rear side, right and left sides having vertical openings contained therein, retractable drip tray with spring-like return means, and support brackets containing holes therein for mounting said apparatus against and/or under a kitchen cabinet.

U.S. Pat. No. 3,845,884

BOTTLE WITH AN INVERTED PORTION SUPPORT AND SEALING RING

Hall and Myers

Provided is a plastic bottle for dispensing water to a water cooler. Such water coolers generally include an upper surface having therein an orifice whose inner surface is bounded by a sealing ring. To overcome the problem of contamination often caused by impurities running down the sides of the bottle, past the sealing ting, and into the liquid dispensing area within the cooler, the bottle is provided with at least one annular ridge extending around the entire periphery of the taped section of the bottle, this ridge being an integral part of the outer wall of the taper section and being of a dimension sufficient such that when the bottle is located for dispensing of water by inserting its neck section through the orifice of the cooler, the annular ridge rests upon and overlaps the sealing ring thereby to prevent impurities from entering the apparatus through the orifice.

The present invention differs significantly from the above described patent due to the following unique features described in the present invention such as: open front side, closed rear side, right and left sides having vertical openings contained therein, retractable drip tray with spring-like return means, and support brackets containing holes therein for mounting said apparatus against and/or under a kitchen cabinet.

U.S. Pat. No. 5,127,618

PIVOTING STAND FOR BOTTLE OF WATER DISPENSER

Jean Pierre, Jacques Desjardins and Jean Pierre Desjardins

A water bottle tilting assembly mounted on a water dispensing cabinet is arranged to support the water bottle adjacent the dispensing cabinet at a level so that when the bottle is tilted about an axle the mouth of the bottle automatically reaches the trough of the cabinet with a breakable seal around the mouth of the bottle. A pointed sharp cutter is located inside the trough of the cabinet and breaks the seal when the bottle reaches its upside down position to allow the water to flow in the water dispensing cabinet.

The present invention differs significantly from the above described patent due to the following unique features described in the present invention such as: open front side, closed rear side, right and left sides having vertical openings contained therein, retractable drip tray with spring-like return means, and support brackets containing holes therein for mounting said apparatus against and/or under a kitchen cabinet.

U.S. Pat. No. 3,794,285

CONTAINER HOLDING BRACKET

R. Richard Barts

A bracket for holding a container. The bracket has a bottom shelf upon which the container is supported. The shelf has a horizontal portion which supports the bottom rim of the container and an outer distal end which extends upwardly to engage the bottom wall of the container. The shelf is integrally connected to a vertical wall which projects outwardly and has apertures thereon for receiving fasteners for the mounting of the bracket. The top portion of the bracket is provided with a recess to grippingly receive the handle of the container.

The present invention differs significantly from the above described patent due to the following unique features described in the present invention such as: open front side, closed rear side, right and left sides having vertical openings contained therein, retractable drip tray with spring-like return means, and support brackets containing holes therein for mounting said apparatus against and/or under a kitchen cabinet.

U.S. Pat. No. 3,108,590

WATER DISPENSER

Dennis DiSanto

Disclosed is a self service water dispensing apparatus especially adapted to be located inside a grocery store. This apparatus includes a housing which provides a rigid support structure having a base section which has integral therewith a water storage tank, and an upper section immediately above the base section which includes a plurality of water filling stations. The upper section and base section are joined together and are contiguous with each other along a common generally horizontal plane located about waist high to a typical adult user. This provides a compact and convenient to use structure. The water filling stations each comprise a recessed cubicle having a top wall with a delivery spout therein, an open front side into which a water bottle is placed beneath the spout for fulling, and a floor including a drain. Manually operable control switches are at each vending station. When one of these switches is actuated a pump is energized to pump water from the storage tank to the spout in the filling station associated with the manually operable control switch actuated. A reverse osmosis water purifying unit purifies water from a public supply source and delivers the purified water to the storage tank. A float detects when the level of purified water in the storage tank is low, causing water from a public supply source to be fed through the reverse osmosis unit. As ozone generator periodically generates ozone which is mixed with purified water in the storage tank, and a tap in the storage tank is used for dispensing the ozone treated water to a mister system for spraying produce with the ozone treated water. Spraying produce with ozonated water kills bacteria growing in the misting system. Waste water from the reverse osmosis unit is fed to the cooling tower of the refrigeration system for the grocery store, thereby conserving water.

The present invention differs significantly from the above described patent due to the following unique features described in the present invention such as: open front side, closed rear side, right and left sides having vertical openings contained therein, retractable drip tray with spring-like return means, and support brackets containing holes therein for mounting said apparatus against and/or under a kitchen cabinet.

U.S. Pat. No. 5,222,531

LIQUID CONTAINER SUPPORT AND HYGIENIC LIQUID DISPENSING SYSTEM

Henry E. Baker, David H. Baker, Peter K. Baker, Edward H. Donselman and Ronald C. Katz A hygienic liquid dispensing system includes a cap to close the opening of an inverted liquid container enclosing drinking water or other potable liquid. The cap to close the opening of an inverted liquid container enclosing drinking water or other potable liquid. The cap has a lid portion to overlie and sealingly close the opening and an annular skirt portion extending axially away from the lid to surround a portion is provided with an axially inwardly extending recess including an outer sleeve and an inner plug portion integrally formed with a frangible connection therebetween. A feed tube is dimensioned for forcible insertion into the recess for breaking the frangible connection therebetween. A feed tube is dimensioned for forcible insertion into the recess for breaking the frangible connection and separating the plug portion from the sleeve to permit the discharge of liquid from the container. A mounting apparatus is also provided to fit on the upper portion of a water cooler cabinet and defines an annular ting for supporting the shoulder of an inverted bottle or container thereon. The mounting apparatus also defines a tapered entry portion extending downwardly and inwardly from the annular ring for receiving the neck of the inverted container therein.

The present invention differs significantly from the above described patent due to the following unique features described in the present invention such as: open front side, closed rear side, right and left sides having vertical openings contained therein, retractable drip tray with spring-like return means, and support brackets containing holes therein for mounting said apparatus against and/or under a kitchen cabinet.

U.S. Pat. No. 5,246,141

BOTTLED WATER STATION WITH REMOVABLE RESERVOIR

Bruce D. Burrows

An improved bottled water station includes a removable module for simple drop-in installation into a station housing and to cooperate with station components to provide a selected plurality of water supplies at different temperatures for individual dispensing. The preferred reservoir module comprises a lightweight reservoir of molded plastic or the like having an open upper end for receiving and supporting an inverted water bottle, and an internal baffle plate which divides the interior of the reservoir into upper and lower chambers. A fitting on a lower end of the reservoir permits sealed reception of a chiller probe into the lower chamber, wherein the chiller probe is provided as pan of a refrigeration system on the station housing. In addition, a fitting on the lower end of the reservoir interconnects water from the upper reservoir and are disposed in accessible positions at the front of the station housing for individual dispensing of chilled water from the lower reservoir chamber and hot water from the heated tank. If desired, another faucet valve may be provided for dispensing water substantially at room temperature from the upper reservoir chamber. An improved chiller probe and improved heated water tank are also disclosed.

The present invention differs significantly from the above described patent due to the following unique features described in the present invention such as: open front side, closed rear side, right and left sides having vertical openings contained therein, retractable drip tray with spring-like return means, and support brackets containing holes therein for mounting said apparatus against and/or under a kitchen cabinet.

Numerous innovations for a bottle container housing having a retractable drip tray have been provided in the prior art that are adapted to be used. Even though these innovations may be suitable for the specific individual purposes to which they address, they would not be suitable for the purposes of the present invention as heretofore described.

SUMMARY OF THE INVENTION

It is an object of the present invention to provide a new and improved housing for holding a container.

It is a further object of the present invention to provide a housing for holding a container having a retractable drip tray slidably mounted in the main body of the housing under the bottom of the housing while supporting the container enclosure against and/or under a kitchen cabinet.

It is a primary object of the present invention to provide a housing for holding a container having a retractable drip tray slidably mounted therein which allows for the removal of a partially and/or filled liquid container.

Accordingly, it is an object of the present invention to provide a housing for holding a container having a retractable drip tray slidably mounted being molded in one piece.

More particularly, it is an object of the present invention to provide a housing for holding a container having a retractable drip tray slidably mounted an open front and a closed back panel.

In keeping with these objects, and with others which will become apparent hereinafter, one feature of the present invention resides, briefly stated, in a housing for holding a container having a retractable drip tray slidably mounted having two side panels with an open vertical strip contained therein.

When the housing for holding a container having a retractable drip tray slidably mounted is designed in accordance with the present invention,the top and bottom panels are closed.

In accordance with another feature of the present invention, the bottom panel has four upwardly extending bosses for engaging one or both of the linear reliefs which are molded into most one gallon water bottles for improved hoop strength preventing the bottle from moving when the tap is pulled outwardly or inwardly. For bottles that do not have these linear reliefs or when they are not coincident with the bosses, the bottle just sits on top of the bosses.

Another feature of the present invention is that a housing for holding a container having a retractable drip tray slidably mounted having a drip tray which is moveable within slides at either side of the bottom of the enclosure.

Yet another feature of the present invention is having a drip tray terminating at a V-shaped spring which is held in place by a short rod shaped stub extending downwardly from the bottom panel being molded in place. The spring is held onto the stub by spring tension. The spring is in contact with the rear of the tray forcing the tray to move in an extended position when the spring is relaxed, therefore, positioned to catch water drips from the tap, when the tap is not in use.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

8—bottle enclosure with drip tray 10
10—drip tray 10
10A—drip tray front 10A
10B—drip tray left side 10B
10C—drip tray right side 10C
10D—drip tray bottom 10D
10E—drip tray back 10E
10F—drip tray direction 10F
12—bottle enclosure 12
12A—bottle enclosure front 12A
12AB—bottle enclosure front lower right side 12AB
12AC—bottle enclosure front lower left side 12AC
12AD—bottle enclosure front drip tray opening 12AD
12AE—bottle enclosure front opening 12AE
12B—bottle enclosure right side 12B
12BA—bottle enclosure right side lower front horizontal bracket 12BA
12BB—bottle enclosure right side lower front horizontal bracket mounting holes 12BB
12BC—bottle enclosure right side upper front horizontal bracket 12BC
12BD—bottle enclosure right side upper front horizontal bracket mounting holes 12BD
12BE—bottle enclosure right side opening 12BE
12BH—bottle enclosure right side upper rear horizontal bracket mounting holes 12BH
12BI—bottle enclosure right side lower rear horizontal bracket mounting holes 12BI
12BJ—bottle enclosure right side upper front horizontal bracket 12BJ
12BK—bottle enclosure right side lower rear horizontal bracket 12BK
12C—bottle enclosure left side 12C
12CA—bottle enclosure left side lower front horizontal bracket 12CA
12CB—bottle enclosure left side lower front horizontal bracket mounting holes 12CB
12CC—bottle enclosure left side upper front horizontal bracket 12CC
12CD—bottle enclosure left side upper front horizontal bracket mounting holes 12CD
12CE—bottle enclosure left side opening 12CE
12CF—bottle enclosure left side lower rear horizontal bracket 12CF
12CG—bottle enclosure left side lower rear vertical bracket 12CG
12D—bottle enclosure rear side 12D
12DA—bottle enclosure rear side upper vertical left bracket 12DA
12DB—bottle enclosure rear side middle vertical left bracket 12DB
12DC—bottle enclosure rear side lower vertical left bracket 12DC
12DD—bottle enclosure rear side upper horizontal bracket 12DD
12DE—bottle enclosure rear side lower horizontal bracket 12DE
12DF—bottle enclosure rear side left panel 12DF
12DG—bottle enclosure rear side middle panel 12DG
12DH—bottle enclosure rear side right panel 12DH
12DI—bottle enclosure rear side upper vertical right bracket 12DI
12DJ—bottle enclosure rear side middle vertical right bracket 12DJ
12DK—bottle enclosure rear side lower vertical right bracket 12DK
12E—bottle enclosure bottom 12E
12EA—bottle enclosure bottom front left lengthwise support bracket 12EA
12EB—bottle enclosure bottom front right lengthwise support bracket 12EB
12EC—bottle enclosure bottom widthwise support brackets 12EC
12ED—bottle enclosure bottom rear lengthwise support brackets 12ED
12EE—bottle enclosure bottom left side bottle stopper 12EE
12EF—bottle enclosure bottom right side bottle stopper 12EF
12EG—bottle enclosure bottom V-spring post 12EG
12F—bottle enclosure top 12F
12FA—bottle enclosure top left front bracket mounting holes 12FA
12FB—bottle enclosure top right front bracket mounting holes 12FB
12FC—bottle enclosure top left rear bracket mounting holes 12FC
12FD—bottle enclosure top right rear bracket mounting holes 12FD
12FE—bottle enclosure left side horizontal bracket 12FE
12FF—bottle enclosure right side horizontal bracket 12FE
14—bottle 14
14A—bottle spout horizontal member 14A
14B—bottle spout fluid release suppression button 14B
14C—bottle spout vertical member 14C
14D—bottle spout drip 14D
14E—bottle spout drip puddle 14E
16—V-shaped spring 16
16A—V-shaped spring post retainer 16A
16B—V-shaped spring right spring lengthwise member 16B
16C—V-shaped spring left spring lengthwise member 16C
16D—V-shaped spring right spring widthwise member 16D
16E—V-shaped spring left spring widthwise member 16E
16F—V-shaped spring uncompressed direction 16F
16G—V-shaped spring compressed direction 16G
18—fluid container 18

DETAILED LIST OF REFERENCE NUMERALS UTILIZED IN THE DRAWING

8—bottle enclosure with drip tray 8 having a slidably mounted drip tray 10 positioned at the lower front distal end of bottle enclosure 12 housing a bottle 14 having a drip tray V-shaped spring 16 functioning to contact a drip tray back 10E forcing said drip tray 10 to move in a retracted position when said V-shaped spring 16 is compressed in a V-shaped spring compressed direction 16G when a fluid container 18 is placed in fluid filling position as well as having a drip tray V-shaped spring 16 functioning to contact a drip tray back 10E forcing said drip tray 10 to move in a relaxed position when a fluid container 18 is removed an extended position when said V-shaped spring 16 is relaxed in V-shaped spring uncompressed direction 16F when a fluid container 18 is removed;

10—drip tray 10 comprising: a drip tray front 10A, drip tray left side 10B, drip tray right side 10C, and drip tray bottom 10D, drip tray back 10E functioning as a waterproof collecting apparatus capable of being slidably inserted under a bottle 14 to collect bottle spout drip 14D;

10A—drip tray front 10A being waterproofly connected on one distal side to drip tray left side 10B and waterproofly connected on the opposite distal side to drip tray right side 10C and waterproofly connected at a longitudinal distal side to drip tray bottom 10D;

10B—drip tray left side 10B being waterproofly connected on one distal side to drip tray front 10A and waterproofly connected on the opposite distal side to drip tray back 10E and waterproofly connected at a longitudinal distal side to drip tray bottom 10D;

10C—drip tray right side 10C being waterproofly connected on one distal side to drip tray front 10A and waterproofly connected on the opposite distal side to drip tray back 10E and waterproofly connected at a longitudinal distal side to drip tray bottom 10D;

10D—drip tray bottom 10D being waterproofly connected on one distal side to drip tray front 10A and waterproofly connected on the opposite distal side to drip tray back 10E and waterproofly connected on one longitudinal distal side to drip tray left side 10B and waterproofly connected on an opposite longitudinal distal side to drip tray right side 10C;

10E—drip tray back 10E being waterproofly connected on one distal side to drip tray left side 10B and waterproofly connected on the opposite distal side to drip tray right side 10C and waterproofly connected at a longitudinal distal side to drip tray bottom 10D;

10F—drip tray direction 10F being the slidable direction whereby said drip tray 10 moves while a fluid container 18 is being filled and/or removed after filling;

12—bottle enclosure 12 comprising: a bottle enclosure front 12A, a bottle enclosure right side 12B, a bottle enclosure left side 12C, a bottle enclosure rear side 12D, a bottle enclosure bottom 12E, and a bottle enclosure top 12F;

12A—bottle enclosure front 12A being securely fastened to: bottle enclosure right side 12B, bottle enclosure left side 12C, bottle enclosure bottom 12E, and bottle enclosure top 12F having bottle enclosure front drip tray opening 12AD functioning to accept a drip tray 10 therein as well as having a bottle enclosure front opening 12AE functioning to accept a bottle 14 therein;

12AB—bottle enclosure front lower right side 12AB being securely fastened to bottle enclosure bottom 12E functioning as a guide for drip tray 10;

12AC—bottle enclosure front lower left side 12AC being securely fastened to bottle enclosure bottom 12E functioning as a guide for drip tray 10;

12AD—bottle enclosure front drip tray opening 12AD being formed by bottle enclosure front lower right side 12AB, bottle enclosure front lower left side 12AC and bottle enclosure bottom 12E functioning to accept drip tray 10 therein;

12AE—bottle enclosure front opening 12AE being formed by bottle enclosure right side 12B, bottle enclosure left side 12C, bottle enclosure top 12F, and bottle enclosure bottom 12E functioning to accept a bottle 14 therein;

12B—bottle enclosure right side 12B being securely connected to bottle enclosure top 12F and being securely connected to bottle enclosure bottom 12E having bottle enclosure right side opening 12BE positioned therein as well as having bottle enclosure right side horizontal bracket mounting holes 12BD, 12BB, 12BH, and 12BI functioning to mount said bottle enclosure with drip tray 8 against a kitchen cabinet;

12BA—bottle enclosure right side lower front horizontal bracket 12BA being securely positioned between bottle enclosure front 12A and bottle enclosure right side opening 12BE functioning as a rigid support, thus, improving hoop strength;

12BB—bottle enclosure right side lower front horizontal bracket mounting holes 12BB being positioned within bottle enclosure right side lower front horizontal bracket 12BA allowing mounting of bottle enclosure with drip tray 8 to a kitchen cabinet;

12BC—bottle enclosure right side upper front horizontal bracket 12BC being securely positioned between bottle enclosure front 12A and bottle enclosure right side opening 12BE functioning as a rigid support, thus, improving hoop strength;

12BD—bottle enclosure right side upper front horizontal bracket mounting holes 12BD being positioned within bottle enclosure right side upper front horizontal bracket 12BJ functioning to mount said bottle enclosure with drip tray 8 against a kitchen cabinet;

12BE—bottle enclosure right side opening 12BE being positioned in a vertical fashion within bottle enclosure right side 12B;

12BH—bottle enclosure right side upper rear horizontal bracket mounting holes 12BH being positioned within bottle enclosure right side upper rear horizontal bracket 12BC functioning to mount said boule enclosure with drip tray 8 against a kitchen cabinet;

12BI—bottle enclosure right side lower rear horizontal bracket mounting holes 12BI being positioned within bottle enclosure right side lower rear horizontal bracket 12BK functioning to mount said boule enclosure with drip tray 8 against a kitchen cabinet;

12BJ—bottle enclosure right side upper front horizontal bracket 12BJ being securely positioned between bottle enclosure rear side 12D and bottle enclosure right side opening 12BE functioning as a rigid support, thus, improving hoop strength;

12BK—bottle enclosure right side lower front horizontal bracket 12BK being securely positioned between bottle enclosure rear side 12D and bottle enclosure right side opening 12BE functioning as a rigid support, thus, improving hoop strength;

12C—bottle enclosure left side 12C being securely connected to bottle enclosure top 12F and being securely connected to bottle enclosure bottom 12E having bottle enclosure right side opening 12BE positioned therein as well as having bottle enclosure right side horizontal bracket mounting holes 12BD, 12BB, 12BH, and 12BI functioning to mount said bottle enclosure with drip tray 8 against a kitchen cabinet;

12CA—bottle enclosure left side lower front horizontal bracket 12CA being securely positioned between bottle enclosure rear side 12D and bottle enclosure left side opening 12CE functioning as a rigid support, thus, improving hoop strength;

12CB—bottle enclosure left side lower front horizontal bracket mounting holes 12CB being positioned within bottle enclosure left side lower front horizontal bracket 12CA allowing mounting of bottle enclosure with drip tray 8 to a kitchen cabinet;

12CC—bottle enclosure left side upper front horizontal bracket 12CC being securely positioned between bottle enclosure front 12A and bottle enclosure left side opening 12CE functioning as a rigid support, thus, improving hoop strength;

23CD—bottle enclosure left side upper front horizontal bracket mounting holes 12CD being positioned within bottle enclosure left side upper front horizontal bracket 12CC allowing mounting of bottle enclosure with drip tray 8 to a kitchen cabinet;

12CE—bottle enclosure left side opening 12CE being positioned in a vertical fashion within bottle enclosure left side 12CE;

12CF—bottle enclosure left side lower rear horizontal bracket 12CF being positioned between bottle enclosure left side opening 12CE and bottle enclosure rear side 12D functioning as a rigid support, thus, improving hoop strength;

12CG—bottle enclosure left side lower rear vertical bracket 12CG being positioned between bottle enclosure left side lower rear horizontal bracket 12CF and bottle enclosure bottom 12E functioning as a rigid support, thus, improving hoop strength;

12D—bottle enclosure rear side 12D being securely fastened to: bottle enclosure right side 12B, bottle enclosure left side 12C, bottle enclosure bottom 12E, and bottle enclosure top 12F functioning as a rigid support, thus, improving hoop strength;

12DA—bottle enclosure rear side upper vertical left bracket 12DA being securely connected to bottle enclosure top 12F at a top distal end and bottle enclosure rear side middle vertical left bracket 12DB at a bottom distal end functioning as a rigid support, thus, improving hoop strength;

12DB—bottle enclosure rear side middle vertical left bracket 12DB being securely connected to bottle enclosure rear side upper vertical left bracket 12DA at a top distal end and bottle enclosure rear side lower vertical left bracket 12DC at a bottom distal end functioning as a rigid support, thus, improving hoop strength;

12DC—bottle enclosure rear side lower vertical left bracket 12DC being securely connected to bottle enclosure rear side middle vertical left bracket 12DB at a top distal end and bottle enclosure bottom 12E at a bottom distal end functioning as a rigid support, thus, improving hoop strength;

12DD—bottle enclosure rear side upper horizontal bracket 12DD being securely fastened at a left distal end to bottle enclosure rear side upper vertical left bracket 12DA and bottle enclosure rear side middle vertical left bracket 12DB as well as being securely fastened at a right distal end to bottle enclosure rear side upper vertical right bracket 12DI and bottle enclosure rear side middle vertical right side bracket 12DJ functioning as a rigid support, thus, improving hoop strength 12DE—bottle enclosure rear side lower horizontal bracket 12DE being securely fastened at a left distal end to bottle enclosure rear side middle vertical left bracket 12DB and bottle enclosure rear side lower vertical left bracket 12DC as well as being securely fastened at a right distal end to bottle enclosure rear side upper vertical right bracket 12DI and bottle enclosure rear side middle vertical right side bracket 12DJ functioning as a rigid support, thus, improving hoop strength;

12DF—bottle enclosure rear side left panel 12DF being securely fastened and positioned between bottle enclosure left side 12C at a longitudinal left distal side as well as being securely fastened and positioned at a right longitudinal distal side to: bottle enclosure rear side upper vertical left bracket 12DA, bottle enclosure rear side middle vertical left bracket 12DB, bottle enclosure rear side lower vertical left bracket 12DC functioning as a rigid support, thus, improving hoop strength;

12DG—bottle enclosure rear side middle panel 12DG being securely fastened and positioned between: bottle enclosure rear side upper vertical right bracket 12DI, bottle enclosure rear side middle vertical right bracket 12DJ, and bottle enclosure rear side lower vertical right bracket 12DK at a longitudinal right distal side as well as being securely fastened and positioned at a left longitudinal distal side to: bottle enclosure rear side upper vertical left bracket 12DA, bottle enclosure rear side middle vertical left bracket 12DB, bottle enclosure rear side lower vertical left bracket 12DC having bottle enclosure rear side upper horizontal bracket 12DD bottle enclosure rear side lower horizontal bracket 12DE mounted thereon functioning as a rigid support, thus, improving hoop strength;

12DH—bottle enclosure rear side right panel 12DH being securely fastened and positioned between bottle enclosure right side at a longitudinal right distal side as well as being securely fastened and positioned at a left longitudinal distal side to: bottle enclosure rear side upper vertical right bracket 12DI, bottle enclosure rear side middle vertical right bracket 12DJ, and bottle enclosure rear side lower vertical right bracket 12DK functioning as a rigid support, thus, improving hoop strength;

12DI—bottle enclosure rear side upper vertical right bracket 12DI being securely connected to bottle enclosure top 12F at a top distal end and bottle enclosure rear side middle vertical right bracket 12DJ at a bottom distal end functioning as a rigid support, thus, improving hoop strength;

12DJ—bottle enclosure rear side middle vertical right bracket 12DJ being securely connected to bottle enclosure rear side upper vertical right bracket 12DI at a top distal end and bottle enclosure rear side lower vertical right bracket 12DK at a bottom distal end functioning as a rigid support, thus, improving hoop strength;

12DK—bottle enclosure rear side lower vertical right bracket 12DK being securely connected to bottle enclosure rear side middle vertical right bracket 12DJ at a top distal end and bottle enclosure bottom 12E at a bottom distal end functioning as a rigid support, thus, improving hoop strength;

12E—bottle enclosure bottom 12E being securely fastened to: bottle enclosure right side 12B, bottle enclosure left side 12C, bottle enclosure front 12A, and bottle enclosure rear side 12D functioning as a rigid support, thus, improving hoop strength;

12EA—bottle enclosure bottom front left lengthwise support bracket 12EA being securely fastened to bottle enclosure front 12A at a front distal end and securely fastened to bottle enclosure bottom widthwise support brackets 12EC at a rear distal end functioning as a rigid support for bottle 14, thus, improving bottom support strength;

12EB—bottle enclosure bottom front right lengthwise support bracket 12EB being securely fastened to bottle enclosure front 12A at a front distal end and securely fastened to bottle enclosure bottom widthwise support brackets 12EC at a rear distal end functioning as a rigid support for bottle 14, thus, improving bottom support strength;

12EC—bottle enclosure bottom widthwise support brackets 12EC being securely fastened to bottle enclosure left side 12C at a left distal end and securely fastened to bottle enclosure right side 12B at a right distal end having bottle enclosure bottom rear lengthwise support brackets 12ED securely fastened therebetween functioning as a rigid support for bottle 14, thus, improving bottom support strength;

12ED—bottle enclosure bottom rear lengthwise support brackets 12ED securely fastened at a front, middle and rear position to bottle enclosure bottom widthwise support brackets 12EC functioning as a rigid support for bottle 14, thus, improving bottom support strength;

12EE—bottle enclosure bottom left side bottle stopper 12EE being securely fastened to bottle enclosure left side 12C at a left distal end and securely fastened to bottle enclosure bottom rear lengthwise support brackets 12ED at a right distal end functioning to engage one or more linear reliefs which are molded into standard water bottles and as a rigid support for bottle 14, thus, improving bottom support and hoop strength, thus, preventing bottle 14 from moving when bottle spout fluid release suppression button 14B is pushed inwardly;

12EF—bottle enclosure bottom right side bottle stopper 12EF being securely fastened to bottle enclosure right side 12B at a right distal end and securely fastened to bottle enclosure bottom rear lengthwise support brackets 12ED at a left distal end functioning to engage one or more linear reliefs which are molded into standard water bottles and as a rigid support for bottle 14, thus, improving bottom support and hoop strength, thus, preventing bottle 14 from moving when bottle spout fluid release suppression button 14B is pushed inwardly;

12EG—bottle enclosure bottom V-spring post 12EG being securely mounted upon bottle enclosure bottom 12E functioning to provide a securing and pivoting means for V-shaped spring post retainer 16A;

12F—bottle enclosure top 12F being securely fastened to: bottle enclosure right side 12B, bottle enclosure left side 12C, bottle enclosure front 12A, and bottle enclosure rear side 12D functioning as a rigid support, thus, improving hoop strength;

12FA—bottle enclosure top left front bracket mounting holes 12FA being positioned within bottle enclosure left side horizontal bracket 12FE functioning to mount said bottle enclosure with drip tray 8 under a kitchen cabinet;

12FB—bottle enclosure top right front bracket mounting holes 12FB being positioned within bottle enclosure right side horizontal bracket 12FF functioning to mount said bottle enclosure with drip tray 8 under a kitchen cabinet;

12FC—bottle enclosure top left rear bracket mounting holes 12FC being positioned within bottle enclosure left side horizontal bracket 12FE functioning to mount said bottle enclosure with drip tray 8 under a kitchen cabinet;

12FD—bottle enclosure top right rear bracket mounting holes 12FD being positioned within bottle enclosure right side horizontal bracket 12FF functioning to mount said bottle enclosure with drip tray 8 under a kitchen cabinet;

12FE—bottle enclosure left side horizontal bracket 12FE being securely fastened at a front distal end to bottle enclosure front 12A and at a rear distal end to bottle enclosure rear side 12D functioning as a rigid support for bottle 14 and providing support strength for mounting said bottle enclosure with drip tray 8 under a kitchen cabinet;

12FF—bottle enclosure right side horizontal bracket 12FE being securely fastened at a front distal end to bottle enclosure front 12A and at a rear distal end to bottle enclosure rear side 12D functioning as a rigid support for bottle 14 and providing support strength for mounting said bottle enclosure with drip tray 8 under a kitchen cabinet;

14—bottle 14 being contained within bottle enclosure and drip tray 8 functioning to contain fluid therein;

14A—bottle spout horizontal member 14A being waterproofly mounted upon bottle 14 functioning to allow fluid contained within bottle 14 to be released filling fluid container 18;

14B—bottle spout fluid release suppression button 14B being mounted within bottle spout horizontal member 14A functioning as an ON/OFF switch allowing fluid contained within bottle 14 to be released filling fluid container 18;

14C—bottle spout vertical member 14C waterproofly mounted upon bottle spout horizontal member 14A functioning to allow fluid contained within bottle 14 to be released filling fluid container 18;

14D—bottle spout drip 14D being released from bottle spout vertical member 14C after bottle spout fluid release suppression button 14 is shut OFF and fluid container 18 is removed;

14E—bottle spout drip puddle 14E being an accumulation of bottle spout drips 14D released from bottle spout vertical member 14C after bottle spout fluid release suppression button 14 is shut OFF and fluid container 18 is removed;

16—V-shaped spring 16 having: V-shaped spring post retainer 16A, V-shaped spring right spring lengthwise member 16B, V-shaped spring left spring lengthwise member 16C, V-shaped spring right spring widthwise member 16D, V-shaped spring left spring widthwise member 16E functioning as a return spring-like means whereby when V-shaped spring is in an uncompressed direction 16F drip tray 10 is extended outwardly, thus, catching bottle spout drip puddle 14E being an accumulation of bottle spout drips 14D released from bottle spout vertical member 14C after bottle spout fluid release suppression button 14 is shut OFF and fluid container 18 is removed as well as when V-shaped spring compressed direction 16G allowing drip tray 10 to slidably be inserted into drip tray opening 12AD in a drip tray direction 10F when a user is filing fluid container 18;

16A—V-shaped spring post retainer 16A being securely and slidably mounted upon bottle enclosure bottom V-spring post 12EG functioning as a securing and pivoting means when V-shaped spring is compressed and uncompressed;

16B—V-shaped spring right spring lengthwise member 16B being positioned between V-shaped spring post retainer 16A and V-shaped spring right spring widthwise member 16D functioning to provide spring-like outward ejection means when filling container 18 is removed and drip tray 10 is extended outwardly in a resting position;

16C—V-shaped spring left spring lengthwise member 16C being positioned between V-shaped spring post retainer 16A and V-shaped spring left spring widthwise member 16E functioning to provide spring-like outward ejection means when filling container 18 is removed and drip tray 10 is extended outwardly in a resting position;

16D—V-shaped spring right spring widthwise member 16D being located at a distal end of V-shaped spring right spring lengthwise member 16B having a curvature thereby preventing V-spring 16 from jamming during usage;

16E—V-shaped spring left spring widthwise member 16E being located at a distal end of V-shaped spring left spring lengthwise member 16C having a curvature thereby preventing V-spring 16 from jamming during usage;

16F—V-shaped spring uncompressed direction 16F being a resting position having drip tray 10 extended outwardly;

16G—V-shaped spring compressed direction 16G being compressed during usage when a filling container 18 is inserted in a position to receive fluid contained within bottle 14;

18—fluid container 18 being a waterproof container whereby when filling is pushed against drip tray 10, thus, compressing V-spring 16 in a V-shaped spring compressed direction 16G allowing drip tray 10 to retract into bottle enclosure front drip tray opening 12AD;

BRIEF DESCRIPTION OF THE PREFERRED EMBODIMENT

Figure 3B:
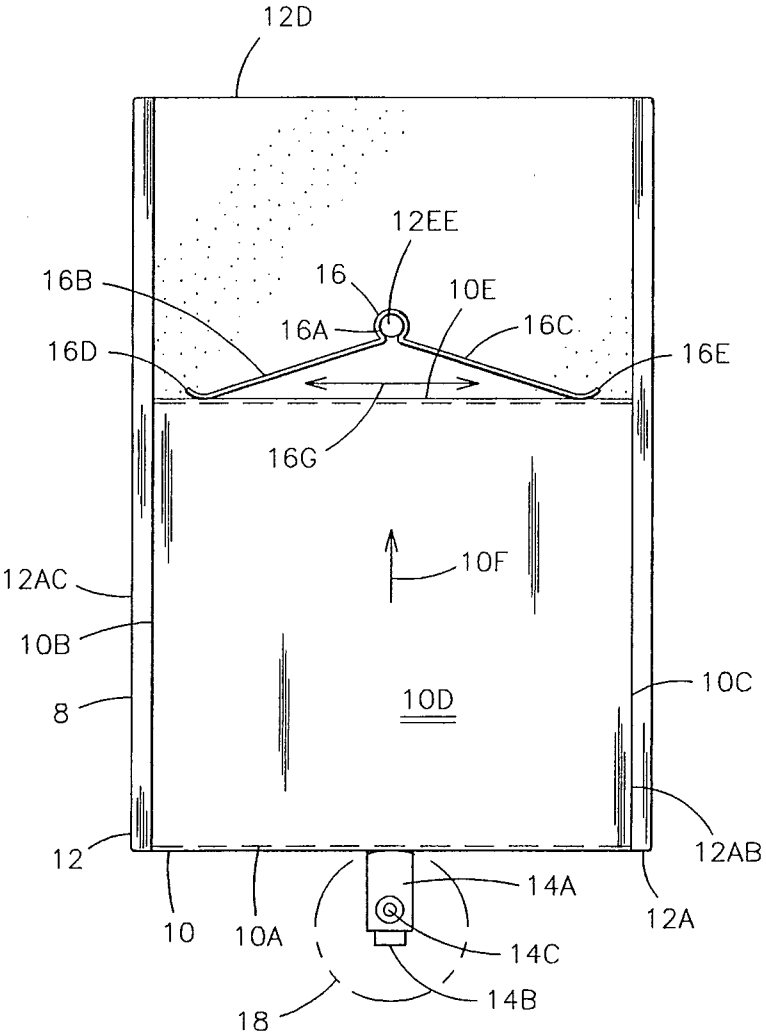
Figure 3A:
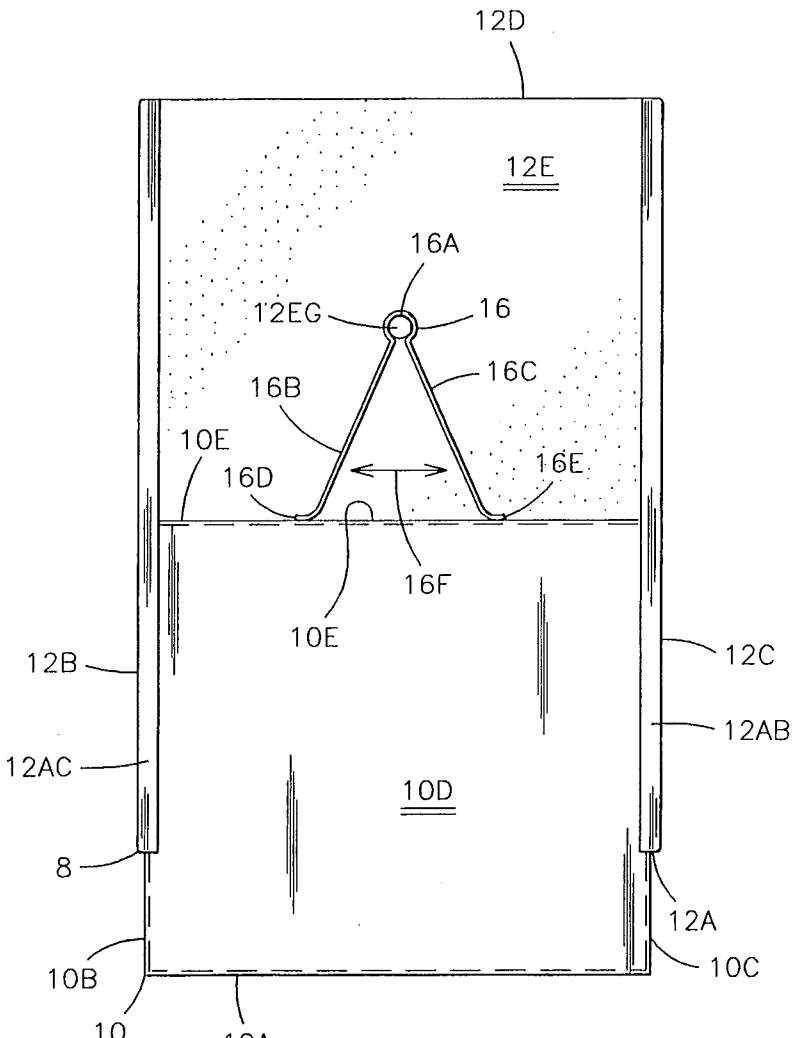
Figure 4:
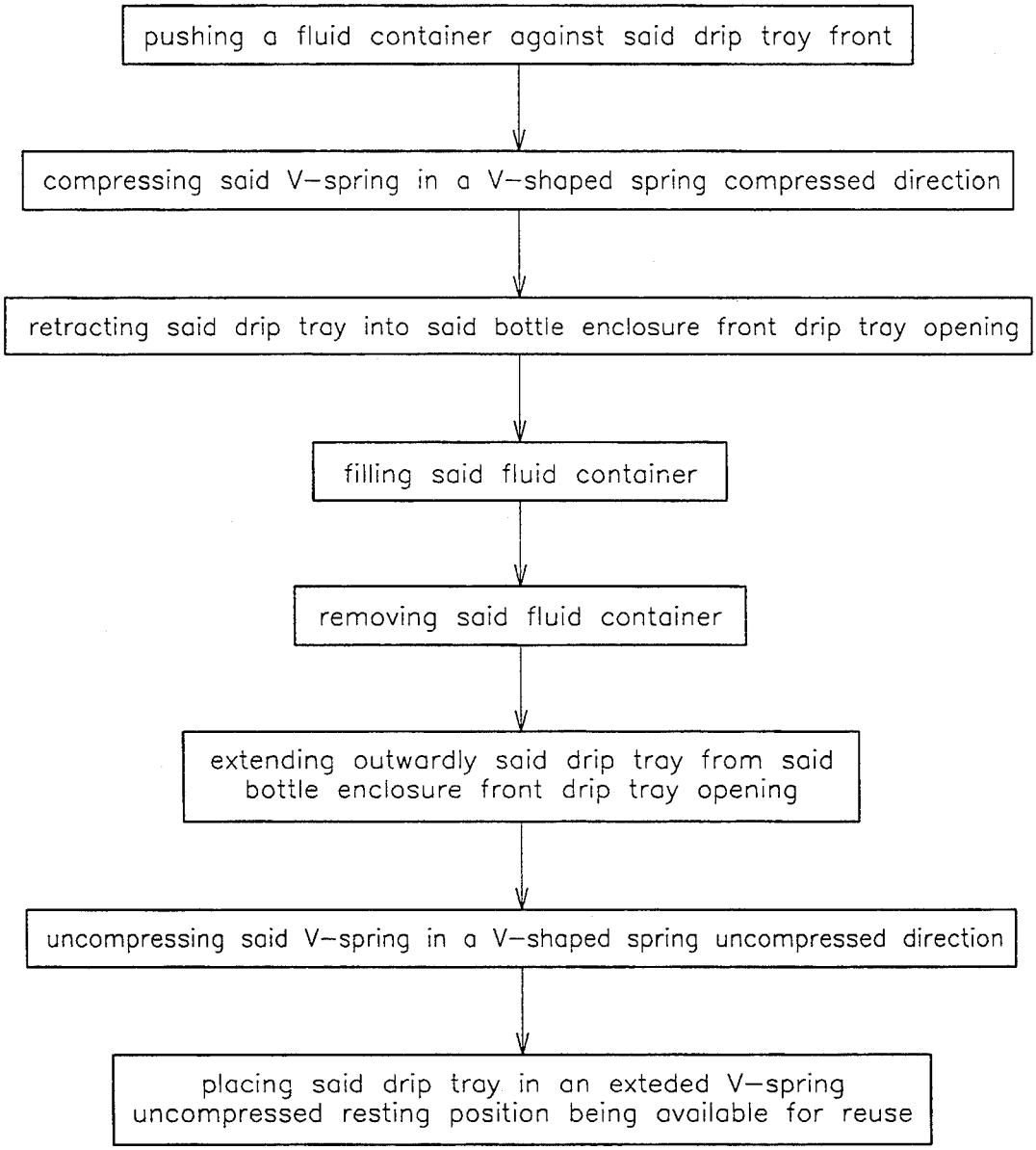

FIG. 3A is a bottom view of a bottle enclose and drip tray having a bottle enclosure bottom V-spring post being securely mounted upon bottle enclosure bottom functioning to provide a securing and pivoting means for V-shaped spring post retainer where as when V-shaped spring is in an uncompressed direction having drip tray extended outwardly being a resting position to collect bottle spout drip puddle being an accumulation of bottle spout drips released from bottle spout vertical member after bottle spout fluid release suppression button is shut OFF and fluid container is removed;

FIG. 3B is a bottom view of a bottle enclose and drip tray having a bottle enclosure bottom V-spring post being securely mounted upon bottle enclosure bottom functioning to provide a securing and pivoting means for V-shaped spring post retainer where as when V-shaped spring is in a compressed direction having drip tray retracted inwardly being a recessed position to allow fluid container to be filled from bottle; and FIG. 4 is a diagrammatic representation of a method of utilizing a bottle enclosure with drip tray.

DETAILED DESCRIPTION OF THE PREFERRED EMBODIMENT

Figure 1:
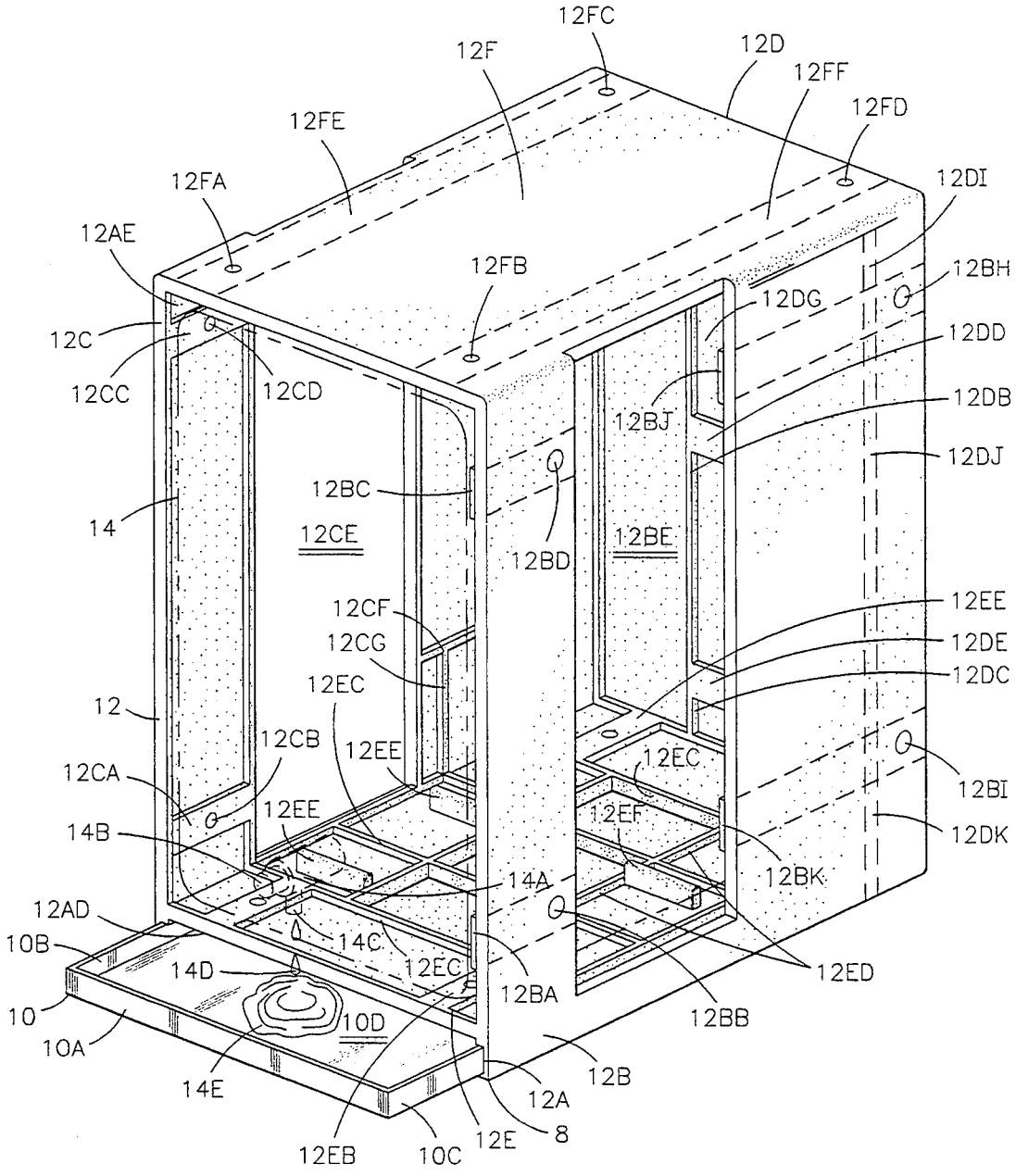
FIG. 1 is a perspective view of a bottle enclosure with drip tray having an open front, closed rear side, and two side panels with open bottle enclosure openings.

Firstly, referring to FIG. 1 which is a perspective view of a bottle enclosure with drip tray 8 having an open bottle enclosure front 12A, closed rear side 12D, and two side panels 12B and 12C with open bottle enclosure openings 12BE and 12CE, respectively exhibiting the following features: bottle enclosure with drip tray 8 having a slidably mounted drip tray 10 positioned at the lower front distal end of bottle enclosure 12 housing a bottle 14 having a drip tray V-shaped spring 16 functioning to contact a drip tray back 10E forcing said drip tray 10 to move in a retracted position when said V-shaped spring 16 is compressed in a V-shaped spring compressed direction 16G when a fluid container 18 is placed in fluid filling position as well as having a drip tray V-shaped spring 16 functioning to contact a drip tray back 10E forcing said drip tray 10 to move in a relaxed position when a fluid container 18 is removed an extended position when said V-shaped spring 16 is relaxed in V-shaped spring uncompressed direction 16F when a fluid container 18 is removed; drip tray 10 comprising: a drip tray front 10A, drip tray left side 10B, drip tray right side 10C, and drip tray bottom 10D, drip tray back 10E functioning as a waterproof collecting apparatus capable of being slidably inserted under a bottle 14 to collect bottle spout drip 14D; drip tray front 10A being waterproofly connected on one distal side to drip tray left side 10B and waterproofly connected on the opposite distal side to drip tray right side 10C and waterproofly connected at a longitudinal distal side to drip tray bottom 10D; drip tray left side 10B being waterproofly connected on one distal side to drip tray front 10A and waterproofly connected on the opposite distal side to drip tray back 10E and waterproofly connected at a longitudinal distal side to drip tray bottom 10D; drip tray right side 10C being waterproofly connected on one distal side to drip tray front 10A and waterproofly connected on the opposite distal side to drip tray back 10E and waterproofly connected at a longitudinal distal side to drip tray bottom 10D; drip tray bottom 10D being waterproofly connected on one distal side to drip tray front 10A and waterproofly connected on the opposite distal side to drip tray back 10E and waterproofly connected on one longitudinal distal side to drip tray left side 10B and waterproofly connected on an opposite longitudinal distal side to drip tray right side 10C; drip tray back 10E being waterproofly connected on one distal side to drip tray left side 10B and waterproofly connected on the opposite distal side to drip tray right side 10C and waterproofly connected at a longitudinal distal side to drip tray bottom 10D; drip tray direction 10F being the slidable direction whereby said drip tray 10 moves while a fluid container 18 is being filled and/or removed after filling; bottle enclosure 12 comprising: a bottle enclosure front 12A, a bottle enclosure right side 12B, a bottle enclosure left side 12C, a bottle enclosure rear side 12D, a bottle enclosure bottom 12E, and a bottle enclosure top 12F; bottle enclosure front 12A being securely fastened to: bottle enclosure right side 12B, bottle enclosure left side 12C, bottle enclosure bottom 12E, and bottle enclosure top 12F having bottle enclosure front drip tray opening 12AD functioning to accept a drip tray 10 therein as well as having a bottle enclosure front opening 12AE functioning to accept a bottle 14 therein; bottle enclosure front lower right side 12AB being securely fastened to bottle enclosure bottom 12E functioning as a guide for drip tray 10; bottle enclosure front lower left side 12AC being securely fastened to bottle enclosure bottom 12E functioning as a guide for drip tray 10; bottle enclosure front drip tray opening 12AD being formed by bottle enclosure front lower right side 12AB, bottle enclosure front lower left side 12AC and bottle enclosure bottom 12E functioning to accept drip tray 10 therein; bottle enclosure front opening 12AE being formed by bottle enclosure right side 12B, bottle enclosure left side 12C, bottle enclosure top 12F, and bottle enclosure bottom 12E functioning to accept a bottle 14 therein; bottle enclosure right side 12B being securely connected to bottle enclosure top 12F and being securely connected to bottle enclosure bottom 12E having bottle enclosure right side opening 12BE positioned therein as well as having bottle enclosure right side horizontal bracket mounting holes 12BD, 12BB, 12BH, and 12BI functioning to mount said bottle enclosure with drip tray 8 against a kitchen cabinet; bottle enclosure right side lower front horizontal bracket 12BA being securely positioned between bottle enclosure front 12A and bottle enclosure right side opening 12BE functioning as a rigid support, thus, improving hoop strength; bottle enclosure right side lower front horizontal bracket mounting holes 12BB being positioned within bottle enclosure right side lower front horizontal bracket 12BA allowing mounting of bottle enclosure with drip tray 8 to a kitchen cabinet; bottle enclosure right side upper front horizontal bracket 12BC being securely positioned between bottle enclosure front 12A and bottle enclosure right side opening 12BE functioning as a rigid support, thus, improving hoop strength; bottle enclosure right side upper front horizontal bracket mounting holes 12BD being positioned within bottle enclosure right side upper front horizontal bracket 12BJ functioning to mount said bottle enclosure with drip tray 8 against a kitchen cabinet; bottle enclosure right side opening 12BE being positioned in a vertical fashion within bottle enclosure right side 12B; bottle enclosure right side upper rear horizontal bracket mounting holes 12BH being positioned within bottle enclosure right side upper rear horizontal bracket 12BC functioning to mount said bottle enclosure with drip tray 8 against a kitchen cabinet; bottle enclosure right side lower rear horizontal bracket mounting holes 12BI being positioned within bottle enclosure right side lower rear horizontal bracket 12BK functioning to mount said bottle enclosure with drip tray 8 against a kitchen cabinet; bottle enclosure right side upper front horizontal bracket 12BJ being securely positioned between bottle enclosure rear side 12D and bottle enclosure right side opening 12BE functioning as a rigid support, thus, improving hoop strength; bottle enclosure right side lower front horizontal bracket 12BK being securely positioned between bottle enclosure rear side 12D and bottle enclosure right side opening 12BE functioning as a rigid support, thus, improving hoop strength; bottle enclosure left side 12C being securely connected to bottle enclosure top 12F and being securely connected to bottle enclosure bottom 12E having bottle enclosure right side opening 12BE positioned therein as well as having bottle enclosure right side horizontal bracket mounting holes 12BD, 12BB, 12BH, and 12BI functioning to mount said bottle enclosure with drip tray 8 against a kitchen cabinet; bottle enclosure left side lower front horizontal bracket 12CA being securely positioned between bottle enclosure rear side 12D and bottle enclosure left side opening 12CE functioning as a rigid support, thus, improving hoop strength; bottle enclosure left side lower front horizontal bracket mounting holes 12CB being positioned within bottle enclosure left side lower front horizontal bracket 12CA allowing mounting of bottle enclosure with drip tray 8 to a kitchen cabinet; bottle enclosure left side upper front horizontal bracket 12CC being securely positioned between bottle enclosure front 12A and bottle enclosure left side opening 12CE functioning as a rigid support, thus, improving hoop strength; bottle enclosure left side upper front horizontal bracket mounting holes 12CD being positioned within bottle enclosure left side upper front horizontal bracket 12CC allowing mounting of bottle enclosure with drip tray 8 to a kitchen cabinet; bottle enclosure left side opening 12CE being positioned in a vertical fashion within bottle enclosure left side 12C; bottle enclosure left side lower rear horizontal bracket 12CF being positioned between bottle enclosure left side opening 12CE and bottle enclosure rear side 12D functioning as a rigid support, thus, improving hoop strength; bottle enclosure left side lower rear vertical bracket 12CG being positioned between bottle enclosure left side lower rear horizontal bracket 12CF and bottle enclosure bottom 12E functioning as a rigid support, thus, improving hoop strength; bottle enclosure rear side 12D being securely fastened to: bottle enclosure right side 12B, bottle enclosure left side 12C, bottle enclosure bottom 12E, and bottle enclosure top 12F functioning as a rigid support, thus, improving hoop strength; bottle enclosure rear side upper vertical left bracket 12DA being securely connected to bottle enclosure top 12F at a top distal end and bottle enclosure rear side middle vertical left bracket 12DB at a bottom distal end functioning as a rigid support, thus, improving hoop strength; bottle enclosure rear side middle vertical left bracket 12DB being securely connected to bottle enclosure rear side upper vertical left bracket 12DA at a top distal end and bottle enclosure rear side lower vertical left bracket 12DC at a bottom distal end functioning as a rigid support, thus, improving hoop strength; bottle enclosure rear side lower vertical left bracket 12DC being securely connected to bottle enclosure rear side middle vertical left bracket 12DB at a top distal end and bottle enclosure bottom 12E at a bottom distal end functioning as a rigid support, thus, improving hoop strength; bottle enclosure rear side upper horizontal bracket 12DD being securely fastened at a left distal end to bottle enclosure rear side upper vertical left bracket 12DA and bottle enclosure rear side middle vertical left bracket 12DB as well as being securely fastened at a right distal end to bottle enclosure rear side upper vertical right bracket 12DI and bottle enclosure rear side middle vertical right side bracket 12DJ functioning as a rigid support, thus, improving hoop strength; bottle enclosure rear side lower horizontal bracket 12DE being securely fastened at a left distal end to bottle enclosure rear side middle vertical left bracket 12DB and bottle enclosure rear side lower vertical left bracket 12DC as well as being securely fastened at a right distal end to bottle enclosure rear side upper vertical right bracket 12DI and bottle enclosure rear side middle vertical right side bracket 12DJ functioning as a rigid support, thus, improving hoop strength; bottle enclosure rear side left panel 12DF being securely fastened and positioned between bottle enclosure left side 12C at a longitudinal left distal side as well as being securely fastened and positioned at a right longitudinal distal side to: bottle enclosure rear side upper vertical left bracket 12DA, bottle enclosure rear side middle vertical left bracket 12DB, bottle enclosure rear side lower vertical left bracket 12DC functioning as a rigid support, thus, improving hoop strength; bottle enclosure rear side middle panel 12DG being securely fastened and positioned between: bottle enclosure rear side upper vertical right bracket 12DI, bottle enclosure rear side middle vertical right bracket 12DJ, and bottle enclosure rear side lower vertical right bracket 12DK at a longitudinal right distal side as well as being securely fastened and positioned at a left longitudinal distal side to: bottle enclosure rear side upper vertical left bracket 12DA, bottle enclosure rear side middle vertical left bracket 12DB, bottle enclosure rear side lower vertical left bracket 12DC having bottle enclosure rear side upper horizontal bracket 12DD bottle enclosure rear side lower horizontal bracket 12DE mounted thereon functioning as a rigid support, thus, improving hoop strength; bottle enclosure rear side right panel 12DH being securely fastened and positioned between bottle enclosure right side at a longitudinal right distal side as well as being securely fastened and positioned at a left longitudinal distal side to: bottle enclosure rear side upper vertical right bracket 12DI, bottle enclosure rear side middle vertical right bracket 12DJ, and bottle enclosure rear side lower vertical right bracket 12DK functioning as a rigid support, thus, improving hoop strength; bottle enclosure rear side upper vertical right bracket 12DI being securely connected to bottle enclosure top 12F at a top distal end and bottle enclosure rear side middle vertical right bracket 12DJ at a bottom distal end functioning as a rigid support, thus, improving hoop strength; bottle enclosure rear side middle vertical right bracket 12DJ being securely connected to bottle enclosure rear side upper vertical right bracket 12DI at a top distal end and bottle enclosure rear side lower vertical right bracket 12DK at a bottom distal end functioning as a rigid support, thus, improving hoop strength; bottle enclosure rear side lower vertical right bracket 12DK being securely connected to bottle enclosure rear side middle vertical right bracket 12DJ at a top distal end and bottle enclosure bottom 12E at a bottom distal end functioning as a rigid support, thus, improving hoop strength; bottle enclosure bottom 12E being securely fastened to: bottle enclosure right side 12B, bottle enclosure left side 12C, bottle enclosure front 12A, and bottle enclosure rear side 12D functioning as a rigid support, thus, improving hoop strength; bottle enclosure bottom front left lengthwise support bracket 12EA being securely fastened to bottle enclosure front 12A at a front distal end and securely fastened to bottle enclosure bottom widthwise support brackets 12EC at a rear distal end functioning as a rigid support for bottle 14, thus, improving bottom support strength; bottle enclosure bottom front right lengthwise support bracket 12EB being securely fastened to bottle enclosure front 12A at a front distal end and securely fastened to bottle enclosure bottom widthwise support brackets 12EC at a rear distal end functioning as a rigid support for bottle 14, thus, improving bottom support strength; bottle enclosure bottom widthwise support brackets 12EC being securely fastened to bottle enclosure left side 12C at a left distal end and securely fastened to bottle enclosure right side 12B at a right distal end having bottle enclosure bottom rear lengthwise support brackets 12ED securely fastened therebetween functioning as a rigid support for bottle 14, thus, improving bottom support strength; bottle enclosure bottom rear lengthwise support brackets 12ED securely fastened at a front, middle and rear position to bottle enclosure bottom widthwise support brackets 12EC functioning as a rigid support for bottle 14, thus, improving bottom support strength; bottle enclosure bottom left side bottle stopper 12EE being securely fastened to bottle enclosure left side 12C at a left distal end and securely fastened to bottle enclosure bottom rear lengthwise support brackets 12ED at a right distal end functioning to engage one or more linear reliefs which are molded into standard water bottles and as a rigid support for bottle 14, thus, improving bottom support and hoop strength, thus, preventing bottle 14 from moving when bottle spout fluid release suppression button 14B is pushed inwardly; bottle enclosure bottom right side bottle stopper 12EF being securely fastened to bottle enclosure right side 12B at a right distal end and securely fastened to bottle enclosure bottom rear lengthwise support brackets 12ED at a left distal end functioning to engage one or more linear reliefs which are molded into standard water bottles and as a rigid support for bottle 14, thus, improving bottom support and hoop strength, thus, preventing bottle 14 from moving when bottle spout fluid release suppression button 14B is pushed inwardly; bottle enclosure bottom V-spring post 12EG being securely mounted upon bottle enclosure bottom 12E functioning to provide a securing and pivoting means for V-shaped spring post retainer 16A; bottle enclosure top 12F being securely fastened to: bottle enclosure right side 12B, bottle enclosure left side 12C, bottle enclosure front 12A, and bottle enclosure rear side 12D functioning as a rigid support, thus, improving hoop strength; bottle enclosure top left front bracket mounting holes 12FA being positioned within bottle enclosure left side horizontal bracket 12FE functioning to mount said bottle enclosure with drip tray 8 under a kitchen cabinet; bottle enclosure top right front bracket mounting holes 12FB being positioned within bottle enclosure right side horizontal bracket 12FF functioning to mount said bottle enclosure with drip tray 8 under a kitchen cabinet; bottle enclosure top left rear bracket mounting holes 12FC being positioned within bottle enclosure left side horizontal bracket 12FE functioning to mount said bottle enclosure with drip tray 8 under a kitchen cabinet; bottle enclosure top right rear bracket mounting holes 12FD being positioned within bottle enclosure right side horizontal bracket 12FF functioning to mount said bottle enclosure with drip tray 8 under a kitchen cabinet; bottle enclosure left side horizontal bracket 12FE being securely fastened at a front distal end to bottle enclosure front 12A and at a rear distal end to bottle enclosure rear side 12D functioning as a rigid support for bottle 14 and providing support strength for mounting said bottle enclosure with drip tray 8 under a kitchen cabinet; bottle enclosure right side horizontal bracket 12FE being securely fastened at a front distal end to bottle enclosure front 12A and at a rear distal end to bottle enclosure rear side 12D functioning as a rigid support for bottle 14 and providing support strength for mounting said bottle enclosure with drip tray 8 under a kitchen cabinet; bottle 14 being contained within bottle enclosure and drip tray 8 functioning to contain fluid therein; bottle spout horizontal member 14A being waterproofly mounted upon bottle 14 functioning to allow fluid contained within bottle 14 to be released filling fluid container 18; bottle spout fluid release suppression button 14B being mounted within bottle spout horizontal member 14A functioning as an ON/OFF switch allowing fluid contained within bottle 14 to be released filling fluid container 18; boule spout vertical member 14C waterproofly mounted upon bottle spout horizontal member 14A functioning to allow fluid contained within bottle 14 to be released filling fluid container 18; and bottle spout drip 14D being released from bottle spout vertical member 14C after bottle spout fluid release suppression button 14 is shut OFF and fluid container 18 is removed; bottle spout drip puddle 14E being an accumulation of bottle spout drips 14D released from bottle spout vertical member 14C after bottle spout fluid release suppression button 14 is shut OFF and fluid container 18 is removed.

Figure 2:
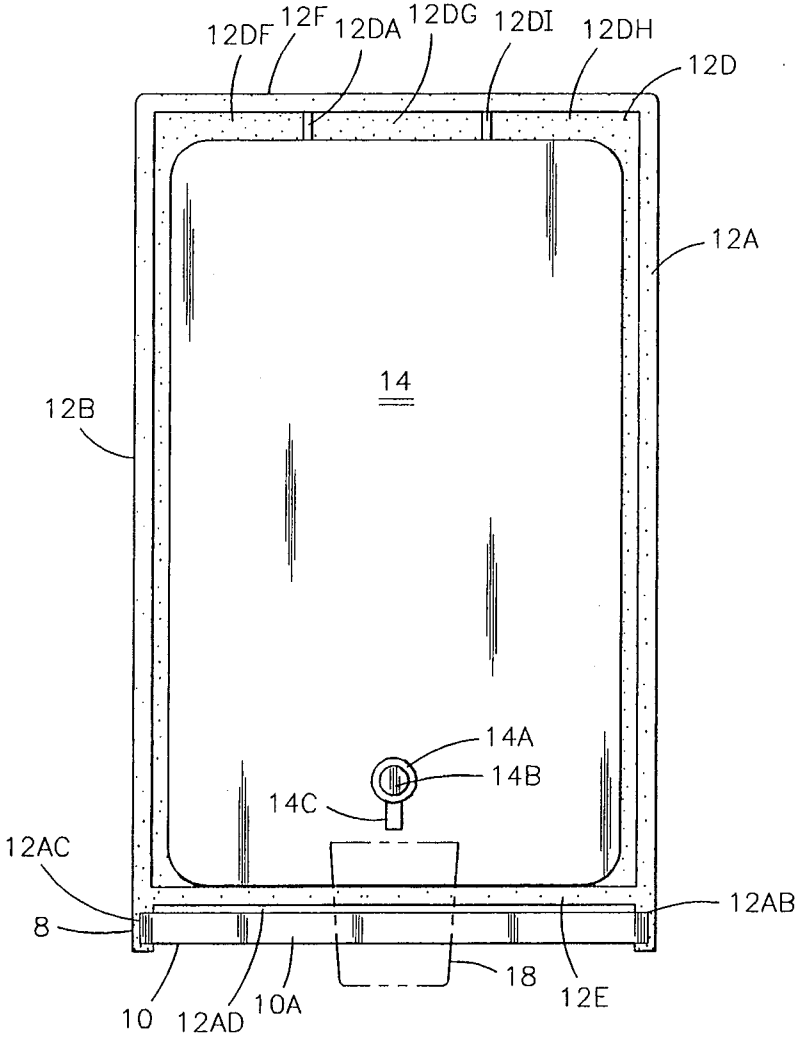
FIG. 2 is a front view of a bottle enclosure and drip tray having a bottle contained therein and filling container being filled thereof.

Now, referring to FIG. 2 which is a front view of a bottle enclosure and drip tray 8 having a bottle 14 contained therein and filling container 18 being filled thereof exhibiting the following features: bottle enclosure with drip tray 8 having a slidably mounted drip tray 10 positioned at the lower front distal end of bottle enclosure 12 housing a bottle 14 having a drip tray V-shaped spring 16 functioning to contact a drip tray back 10E forcing said drip tray 10 to move in a retracted position when said V-shaped spring 16 is compressed in a V-shaped spring compressed direction 16G when a fluid container 18 is placed in fluid filling position as well as having a drip tray V-shaped spring 16 functioning to contact a drip tray back 10E forcing said drip tray 10 to move in a relaxed position when a fluid container 18 is removed an extended position when said V-shaped spring 16 is relaxed in V-shaped spring uncompressed direction 16F when a fluid container 18 is removed; drip tray 10 comprising: a drip tray front 10A, drip tray left side 10B, drip tray right side 10C, and drip tray bottom 10D, drip tray back 10E functioning as a waterproof collecting apparatus capable of being slidably inserted under a bottle 14 to collect bottle spout drip 14D; drip tray front 10A being waterproofly connected on one distal side to drip tray left side 10B and waterproofly connected on the opposite distal side to drip tray right side 10C and waterproofly connected at a longitudinal distal side to drip tray bottom 10D; bottle enclosure front 12A being securely fastened to: bottle enclosure right side 12B, bottle enclosure left side 12C, bottle enclosure bottom 12E, and bottle enclosure top 12F having bottle enclosure front drip tray opening 12AD functioning to accept a drip tray 10 therein as well as having a bottle enclosure front opening 12AE functioning to accept a bottle 14 therein; bottle enclosure front lower right side 12AB being securely fastened to bottle enclosure bottom 12E functioning as a guide for drip tray 10; bottle enclosure front lower left side 12AC being securely fastened to bottle enclosure bottom 12E functioning as a guide for drip tray 10; bottle enclosure front drip tray opening 12AD being formed by bottle enclosure front lower right side 12AB, bottle enclosure front lower left side 12AC and bottle enclosure bottom 12E functioning to accept drip tray 10 therein; bottle enclosure right side 12B being securely connected to bottle enclosure top 12F and being securely connected to bottle enclosure bottom 12E having bottle enclosure right side opening 12BE positioned therein as well as having bottle enclosure right side horizontal bracket mounting holes 12BD, 12BB, 12BH, and 12BI functioning to mount said bottle enclosure with drip tray 8 against a kitchen cabinet; bottle enclosure left side 12C being securely connected to bottle enclosure top 12F and being securely connected to bottle enclosure bottom 12E having bottle enclosure right side opening 12BE positioned therein as well as having bottle enclosure right side horizontal bracket mounting holes 12BD, 12BB, 12BH, and 12BI functioning to mount said bottle enclosure with drip tray 8 against a kitchen cabinet; bottle enclosure rear side 12D being securely fastened to: bottle enclosure right side 12B, bottle enclosure left side 12C, bottle enclosure bottom 12E, and bottle enclosure top 12F functioning as a rigid support, thus, improving hoop strength; bottle enclosure rear side upper vertical left bracket 12DA being securely connected to bottle enclosure top 12F at a top distal end and bottle enclosure rear side middle vertical left bracket 12DB at a bottom distal end functioning as a rigid support, thus, improving hoop strength; bottle enclosure rear side left panel 12DF being securely fastened and positioned between bottle enclosure left side 12C at a longitudinal left distal side as well as being securely fastened and positioned at a right longitudinal distal side to: bottle enclosure rear side upper vertical left bracket 12DA, bottle enclosure rear side middle vertical left bracket 12DB, bottle enclosure rear side lower vertical left bracket 12DC functioning as a rigid support, thus, improving hoop strength; bottle enclosure rear side middle panel 12DG being securely fastened and positioned between: bottle enclosure rear side upper vertical right bracket 12DI, bottle enclosure rear side middle vertical right bracket 12DJ, and bottle enclosure rear side lower vertical right bracket 12DK at a longitudinal right distal side as well as being securely fastened and positioned at a left longitudinal distal side to: bottle enclosure rear side upper vertical left bracket 12DA, bottle enclosure rear side middle vertical left bracket 12DB, bottle enclosure rear side lower vertical left bracket 12DC having bottle enclosure rear side upper horizontal bracket 12DD bottle enclosure rear side lower horizontal bracket 12DE mounted thereon functioning as a rigid support, thus, improving hoop strength; bottle enclosure rear side right panel 12DH being securely fastened and positioned between bottle enclosure right side at a longitudinal right distal side as well as being securely fastened and positioned at a left longitudinal distal side to: bottle enclosure rear side upper vertical right bracket 12DI, bottle enclosure rear side middle vertical right bracket 12DJ, and bottle enclosure rear side lower vertical right bracket 12DK functioning as a rigid support, thus, improving hoop strength; bottle enclosure rear side upper vertical right bracket 12DI being securely connected to bottle enclosure top 12F at a top distal end and bottle enclosure rear side middle vertical right bracket 12DJ at a bottom distal end functioning as a rigid support, thus, improving hoop strength; bottle 14 being contained within bottle enclosure and drip tray 8 functioning to contain fluid therein; bottle spout horizontal member 14A being waterproofly mounted upon bottle 14 functioning to allow fluid contained within bottle 14 to be released filling fluid container 18; bottle spout fluid release suppression button 14B being mounted within bottle spout horizontal member 14A functioning as an ON/OFF switch allowing fluid contained within bottle 14 to be released filling fluid container 18; bottle spout vertical member 14C waterproofly mounted upon bottle spout horizontal member 14A functioning to allow fluid contained within bottle 14 to be released filling fluid container 18; bottle spout drip 14D being released from bottle spout vertical member 14C after bottle spout fluid release suppression button 14 is shut OFF and fluid container 18 is removed; bottle spout drip puddle 14E being an accumulation of boule spout drips 14D released from bottle spout vertical member 14C after bottle spout fluid release suppression button 14 is shut OFF and fluid container 18 is removed; and fluid container 18.

Now, referring to FIG. 3A which is a bottom view of a bottle enclose and drip tray 8 having a bottle enclosure bottom V-spring post 12EG being securely mounted upon bottle enclosure bottom 12E functioning to provide a securing and pivoting means for V-shaped spring post retainer 16A where as when V-shaped spring 16 is in an uncompressed direction 16F having drip tray 10 extended outwardly being a resting position to collect bottle spout drip puddle 14E being an accumulation of bottle spout drips 14D released from bottle spout vertical member 14C after bottle spout fluid release suppression button 14B is shut OFF and fluid container 18 is removed exhibiting the following features: bottle enclosure with drip tray 8 having a slidably mounted drip tray 10; positioned at the lower front distal end of bottle enclosure 12 housing a bottle 14 having a drip tray V-shaped spring 16 functioning to contact a drip tray back 10E forcing said drip tray 10 to move in a retracted position when said V-shaped spring 16 is compressed in a V-shaped spring compressed direction 16G when a fluid container 18 is placed in fluid filing position as well as having a drip tray V-shaped spring 16 functioning to contact a drip tray back 10E forcing said drip tray 10 to move in a relaxed position when a fluid container 18 is removed an extended position when said V-shaped spring 16 is relaxed in V-shaped spring uncompressed direction 16F when a fluid container 18 is removed; drip tray 10 comprising: a drip tray front 10A, drip tray left side 10B, drip tray right side 10C, and drip tray bottom 10D, drip tray back 10E functioning as a waterproof collecting apparatus capable of being slidably inserted under a bottle 14 to collect bottle spout drip 14D; drip tray front 10A being waterproofly connected on one distal side to drip tray left side 10B and waterproofly connected on the opposite distal side to drip tray right side 10C and waterproofly connected at a longitudinal distal side to drip tray bottom 10D; drip tray left side 10B being waterproofly connected on one distal side to drip tray front 10A and waterproofly connected on the opposite distal side to drip tray back 10E and waterproofly connected at a longitudinal distal side to drip tray bottom 10D; drip tray right side 10C being waterproofly connected on one distal side to drip tray front 10A and waterproofly connected on the opposite distal side to drip tray back 10E and waterproofly connected at a longitudinal distal side to drip tray bottom 10D; drip tray bottom 10D being waterproofly connected on one distal side to drip tray front 10A and waterproofly connected on the opposite distal side to drip tray back 10E and waterproofly connected on one longitudinal distal side to drip tray left side 10B and waterproofly connected on an opposite longitudinal distal side to drip tray right side 10C; drip tray back 10E being waterproofly connected on one distal side to drip tray left side 10B and waterproofly connected on the opposite distal side to drip tray right side 10C and waterproofly connected at a longitudinal distal side to drip tray bottom 10D; bottle enclosure 12 comprising: a bottle enclosure front 12A, a bottle enclosure right side 12B, a bottle enclosure left side 12C, a bottle enclosure rear side 12D, a bottle enclosure bottom 12E, and a bottle enclosure top 12F; bottle enclosure front 12A being securely fastened to: bottle enclosure right side 12B, bottle enclosure left side 12C, bottle enclosure bottom 12E, and bottle enclosure top 12F having bottle enclosure front drip tray opening 12AD functioning to accept a drip tray 10 therein as well as having a bottle enclosure front opening 12AE functioning to accept a bottle 14 therein; bottle enclosure front lower right side 12AB being securely fastened to bottle enclosure bottom 12E functioning as a guide for drip tray 10; bottle enclosure front lower left side 12AC being securely fastened to bottle enclosure bottom 12E functioning as a guide for drip tray 10; bottle enclosure right side 12B, bottle enclosure left side 12C, bottle enclosure rear side 12D, bottle enclosure bottom 12E; V-shaped spring 16 having: V-shaped spring post retainer 16A, V-shaped spring right spring lengthwise member 16B, V-shaped spring left spring lengthwise member 16C, V-shaped spring right spring widthwise member 16D, V-shaped spring left spring widthwise member 16E functioning as a return spring-like means whereby when V-shaped spring is in an uncompressed direction 16F drip tray 10 is extended outwardly, thus, catching bottle spout drip puddle 14E being an accumulation of bottle spout drips 14D released from bottle spout vertical member 14C after bottle spout fluid release suppression button 14 is shut OFF and fluid container 18 is removed as well as when V-shaped spring compressed direction 16G allowing drip tray 10 to slidably be inserted into drip tray opening 12AD in a drip tray direction 10F when a user is filling fluid container 18; V-shaped spring post retainer 16A being securely and slidably mounted upon bottle enclosure bottom V-spring post 12EG functioning as a securing and pivoting means when V-shaped spring is compressed and uncompressed; V-shaped spring right spring lengthwise member 16B being positioned between V-shaped spring post retainer 16A and V-shaped spring right spring widthwise member 16D functioning to provide spring-like outward ejection means when filing container 18 is removed and drip tray 10 is extended outwardly in a resting position; V-shaped spring left spring lengthwise member 16C being positioned between V-shaped spring post retainer 16A and V-shaped spring left spring widthwise member 16E functioning to provide spring-like outward ejection means when filling container 18 is removed and drip tray 10 is extended outwardly in a resting position; V-shaped spring right spring widthwise member 16D being located at a distal end of V-shaped spring right spring lengthwise member 16B having a curvature thereby preventing V-spring 16 from jamming during usage; V-shaped spring left spring widthwise member 16E being located at a distal end of V-shaped spring left spring lengthwise member 16C having a curvature thereby preventing V-spring 16 from jamming during usage; and V-shaped spring uncompressed direction 16F being a resting position having drip tray 10 extended outwardly.

Now, referring to FIG. 3B which is a bottom view of a bottle enclose and drip tray 8 having a bottle enclosure bottom V-spring post 12EG being securely mounted upon bottle enclosure bottom 12E functioning to provide a securing and pivoting means for V-shaped spring post retainer 16A whereas when V-shaped spring 16 is in a compressed direction having drip tray 10 retracted inwardly being a recessed position to allow fluid container 18 to be filled from bottle 14 exhibiting the following features: bottle enclosure with drip tray 8 having a slidably mounted drip tray 10; positioned at the lower front distal end of bottle enclosure 12 housing a bottle 14 having a drip tray V-shaped spring 16 functioning to contact a drip tray back 10E forcing said drip tray 10 to move in a retracted position when said V-shaped spring 16 is compressed in a V-shaped spring compressed direction 16G when a fluid container 18 is placed in fluid filling position as well as having a drip tray V-shaped spring 16 functioning to contact a drip tray back 10E forcing said drip tray 10 to move in a relaxed position when a fluid container 18 is removed an extended position when said V-shaped spring 16 is relaxed in V-shaped spring uncompressed direction 16F when a fluid container 18 is removed; drip tray 10 comprising: a drip tray front 10A, drip tray left side 10B, drip tray right side 10C, and drip tray bottom 10D, drip tray back 10E functioning as a waterproof collecting apparatus capable of being slidably inserted under a bottle 14 to collect bottle spout drip 14D; drip tray front 10A being waterproofly connected on one distal side to drip tray left side 10B and waterproofly connected on the opposite distal side to drip tray right side 10C and waterproofly connected at a longitudinal distal side to drip tray bottom 10D; drip tray left side 10B being waterproofly connected on one distal side to drip tray front 10A and waterproofly connected on the opposite distal side to drip tray back 10E and waterproofly connected at a longitudinal distal side to drip tray bottom 10D; drip tray right side 10C being waterproofly connected on one distal side to drip tray front 10A and waterproofly connected on the opposite distal side to drip tray back 10E and waterproofly connected at a longitudinal distal side to drip tray bottom 10D; drip tray bottom 10D being waterproofly connected on one distal side to drip tray front 10A and waterproofly connected on the opposite distal side to drip tray back 10E and waterproofly connected on one longitudinal distal side to drip tray left side 10B and waterproofly connected on an opposite longitudinal distal side to drip tray right side 10C; drip tray back 10E being waterproofly connected on one distal side to drip tray left side 10B and waterproofly connected on the opposite distal side to drip tray right side 10C and waterproofly connected at a longitudinal distal side to drip tray bottom 10D; drip tray direction 10F being the slidable direction whereby said drip tray 10 moves while a fluid container 18 is being filled and/or removed after filling; bottle enclosure 12 comprising: a bottle enclosure front 12A, a bottle enclosure right side 12B, a bottle enclosure left side 12C, a bottle enclosure rear side 12D, a bottle enclosure bottom 12E, and a bottle enclosure top 12F; bottle enclosure front 12A being securely fastened to: bottle enclosure right side 12B, bottle enclosure left side 12C, bottle enclosure bottom 12E, and bottle enclosure top 12F having bottle enclosure front drip tray opening 12AD functioning to accept a drip tray 10 therein as well as having a bottle enclosure front opening 12AE functioning to accept a bottle 14 therein; bottle enclosure front lower right side 12AB being securely fastened to bottle enclosure bottom 12E functioning as a guide for drip tray 10; bottle enclosure front lower left side 12AC being securely fastened to bottle enclosure bottom 12E functioning as a guide for drip tray 10; bottle enclosure right side 12B, bottle enclosure left side 12C, bottle enclosure rear side 12D, bottle enclosure bottom 12E; V-shaped spring 16 having: V-shaped spring post retainer 16A, V-shaped spring right spring lengthwise member 16B, V-shaped spring left spring lengthwise member 16C, V-shaped spring right spring widthwise member 16D, V-shaped spring left spring widthwise member 16E functioning as a return spring-like means whereby when V-shaped spring is in an uncompressed direction 16F drip tray 10 is extended outwardly, thus, catching bottle spout drip puddle 14E being an accumulation of bottle spout drips 14D released from bottle spout vertical member 14C after bottle spout fluid release suppression button 14 is shut OFF and fluid container 18 is removed as well as when V-shaped spring compressed direction 16G allowing drip tray 10 to slidably be inserted into drip tray opening 12AD in a drip tray direction 10F when a user is filling fluid container 18; V-shaped spring post retainer 16A being securely and slidably mounted upon bottle enclosure bottom V-spring post 12EG functioning as a securing and pivoting means when V-shaped spring is compressed and uncompressed; V-shaped spring right spring lengthwise member 16B being positioned between V-shaped spring post retainer 16A and V-shaped spring right spring widthwise member 16D functioning to provide spring-like outward ejection means when filling container 18 is removed and drip tray 10 is extended outwardly in a resting position; V-shaped spring left spring lengthwise member 16C being positioned between V-shaped spring post retainer 16A and V-shaped spring left spring widthwise member 16E functioning to provide spring-like outward ejection means when filling container 18 is removed and drip tray 10 is extended outwardly in a resting position; V-shaped spring right spring widthwise member 16D being located at a distal end of V-shaped spring right spring lengthwise member 16B having a curvature thereby preventing V-spring 16 from jamming during usage; V-shaped spring left spring widthwise member 16E being located at a distal end of V-shaped spring left spring lengthwise member 16C having a curvature thereby preventing V-spring 16 from jamming during usage; V-shaped spring compressed direction 16G being compressed during usage when a filling container 18 is inserted in a position to receive fluid contained within bottle 14; and fluid container 18 being a waterproof container whereby when filling is pushed against drip tray 10, thus, compressing V-spring 16 in a V-shaped spring compressed direction 16G allowing drip tray 10 to retract into bottle enclosure front drip tray opening 12AD.

Lastly, referring to FIG. 4 which is a method of utilizing a bottle enclosure with drip tray 8 comprising the following steps: pushing a fluid:container 18 against said drip tray front side 10A; compressing said V-spring 16 in a V-shaped spring compressed direction 16G; retracting said drip tray 10 into said bottle enclosure front drip tray opening 12AD; filling said fluid container 18; removing said fluid container 18; extending outwardly said drip tray 10 from said bottle enclosure front drip tray opening 12AD; uncompressing said V-spring 16 in a V-shaped spring uncompressed direction 16F; and placing said drip tray 10 in an extended V-spring uncompressed resting position being available for reuse.

It will be understood that each of the elements described above, or two or more together, may also find a useful application in other types of constructions differing from the type described above.

While the invention has been illustrated and described as embodied in a bottle enclosure with drip tray, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A bottle enclosure with drip tray comprising:

a bottle enclosure housing having an open front defined by a bottle enclosure right side, a bottle enclosure left side, a bottle enclosure bottom, and a bottle enclosure top, and further including a bottle enclosure front drip tray support means positioned therein and adapted to accept a drip tray, the open front adapted to accept a bottle therein, a rear side securely fastened to the bottle enclosure right side, the bottle enclosure left side, the bottle enclosure bottom, and the bottle enclosure top so as to function as a rigid support, for improved strength in the bottle enclosure, a slidably mounted drip tray positioned at the lower front distal end of said open bottle enclosure front and engaged with the drip tray support means; and at least one spring-like means securely and pivotly mounted upon said bottle enclosure bottom within said enclosure front drip tray support means functioning to provide a returning means by which said drip tray is slidably returned to a resting position, for catching drips after the drip tray is pressed into an alternate position allowing placement of a cup at the resting position.

2. The bottle enclosure with drip tray of claim 1, wherein the drip tray support means includes a pair of parallel and opposing U-shaped rails positioned from front to rear on the enclosure and sized for accepting the drip tray.

3. The bottle enclosure with drip tray of claim 1 wherein the right, left, rear and top sides include a plurality of through holes for mounting the enclosure to a fixed structural element.

4. The bottle enclosure with drip tray of claim 1 wherein the right and left sides each include a vertically oriented window aperture allowing visual determination of a water level in a water bottle held within the enclosure.

5. The bottle enclosure with drip tray of claim 1 wherein the right, and left, sides each include at least one inwardly extending embossment sized and positioned to engage a groove on the water bottle so as to maintain the water bottle position within the enclosure while drawing water from the bottle.

6. The bottle enclosure with drip tray of claim 1 wherein the bottle enclosure bottom include at least one upwardly extending embossment sized and positioned to engage a groove on the water bottle so as to maintain the water bottle position within the enclosure while drawing water from the bottle.

7. The bottle enclosure with drip tray of claim 1 wherein the at least one spring-like means is a V-shaped flat spring having two V-adjacency legs positioned to rest against the drip tray when said tray is in the resting position, and wherein the spring is sized and positioned such that as the drip tray is moved toward the bottle enclosure rear wall, the legs are spread loading the spring.

8. The bottle enclosure with drip tray of claim 1, wherein said bottle enclosure and drip tray are constructed from a material taken from a group of materials individually and in combination including plastic, plastic composites, metal, metal alloys, epoxy, carbon-graphite, and fiberglass.

9. The bottle enclosure with drip tray of claim 1 wherein the enclosure is molded as a one piece integral part.

* * * * *